US011859823B2

(12) United States Patent
Ganiger et al.

(10) Patent No.: US 11,859,823 B2
(45) Date of Patent: Jan. 2, 2024

(54) COMBUSTOR CHAMBER MESH STRUCTURE

(71) Applicant: General Electric Company, Schenectady, NY (US)

(72) Inventors: Ravindra Shankar Ganiger, Bengaluru (IN); Hiranya Nath, Bengaluru (IN); Daniel J. Kirtley, Blue Ash, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/931,653

(22) Filed: Sep. 13, 2022

(65) Prior Publication Data

US 2023/0366554 A1 Nov. 16, 2023

(30) Foreign Application Priority Data

May 13, 2022 (IN) ..... 202211027571

(51) Int. Cl.
*F23R 3/60* (2006.01)
*F23R 3/00* (2006.01)

(52) U.S. Cl.
CPC ..... *F23R 3/60* (2013.01); *F23R 3/002* (2013.01); *F23R 2900/00012* (2013.01); *F23R 2900/00017* (2013.01)

(58) Field of Classification Search
CPC ... F23M 5/04; F23R 3/002; F23R 3/42; F23R 3/50; F23R 3/54; F23R 3/60; F23R 2900/00012; F23R 2900/00017
See application file for complete search history.

(56) References Cited

U.S. PATENT DOCUMENTS

| | | | | |
|---|---|---|---|---|
| 3,737,152 | A | 6/1973 | Wilson | |
| 3,793,827 | A | 2/1974 | Ekstedt | |
| 3,811,276 | A | 5/1974 | Caruel et al. | |
| 3,845,620 | A | 11/1974 | Kenworthy | |
| 4,004,056 | A | 1/1977 | Carroll | |
| 4,380,896 | A | 4/1983 | Wiebe | |
| 4,848,089 | A * | 7/1989 | Cramer | F23R 3/60 24/581.1 |

(Continued)

FOREIGN PATENT DOCUMENTS

| | | |
|---|---|---|
| EP | 0905353 B1 | 1/2003 |
| EP | 2995863 B1 | 5/2018 |

(Continued)

*Primary Examiner* — Scott J Walthour
(74) *Attorney, Agent, or Firm* — Venable LLP; Michele V. Frank

(57) ABSTRACT

A combustor includes an inner liner and an outer liner defining a combustion chamber. The inner liner includes an inner mesh structure, a plurality of hot side planks mounted to a hot side of the inner mesh structure, and a plurality of cold side planks mounted to a cold side of the inner mesh structure. The outer liner includes an outer mesh structure, a plurality of hot side planks mounted to a hot side of the outer mesh structure, and a plurality of cold side planks mounted to a cold side of the outer mesh structure. The combustor further includes a plurality of clips configured to couple the plurality of hot side planks and the plurality of cold side planks to a plurality of structural elements of the inner mesh structure and the outer mesh structure.

20 Claims, 10 Drawing Sheets

(56) References Cited

U.S. PATENT DOCUMENTS

| | | | | |
|---|---|---|---|---|
| 5,201,799 | A * | 4/1993 | Johnson | F16B 21/18 24/563 |
| 5,265,411 | A * | 11/1993 | Belsom | F23R 3/60 411/529 |
| 6,155,056 | A | 12/2000 | Sampath et al. | |
| 6,427,446 | B1 | 8/2002 | Kraft et al. | |
| 7,017,334 | B2 | 3/2006 | Mayer et al. | |
| 7,152,411 | B2 | 12/2006 | McCaffrey et al. | |
| 7,219,498 | B2 | 5/2007 | Hadder | |
| 7,237,389 | B2 | 7/2007 | Ryan et al. | |
| 7,338,244 | B2 | 3/2008 | Glessner et al. | |
| 7,389,643 | B2 | 6/2008 | Simons et al. | |
| 8,033,114 | B2 | 10/2011 | Hernandez et al. | |
| 8,316,541 | B2 | 11/2012 | Patel et al. | |
| 8,727,714 | B2 | 5/2014 | Snider et al. | |
| 9,080,770 | B2 | 7/2015 | Dudebout et al. | |
| 9,127,565 | B2 | 9/2015 | Keller et al. | |
| 9,328,665 | B2 | 5/2016 | Doerr et al. | |
| 9,341,377 | B2 | 5/2016 | Kramer | |
| 9,360,217 | B2 | 6/2016 | DiCintio et al. | |
| 9,612,017 | B2 | 4/2017 | Vetters | |
| 9,651,258 | B2 | 5/2017 | Graves et al. | |
| 9,709,280 | B2 | 7/2017 | Preston, III | |
| 9,829,199 | B2 | 11/2017 | Mayer | |
| 9,958,159 | B2 | 5/2018 | Smallwood et al. | |
| 10,107,128 | B2 | 10/2018 | Romanov et al. | |
| 10,378,767 | B2 | 8/2019 | Maurer et al. | |
| 10,386,066 | B2 | 8/2019 | Cunha et al. | |
| 10,422,532 | B2 | 9/2019 | Sadil et al. | |
| 10,451,279 | B2 | 10/2019 | Staufer | |
| 10,473,331 | B2 | 11/2019 | Quach et al. | |
| 10,563,865 | B2 | 2/2020 | Chang | |
| 10,598,382 | B2 | 3/2020 | Tu et al. | |
| 10,648,666 | B2 | 5/2020 | Bouldin et al. | |
| 10,767,863 | B2 | 9/2020 | Freeman et al. | |
| 10,801,730 | B2 | 10/2020 | Kramer | |
| 10,801,731 | B2 | 10/2020 | Dillard | |
| 10,808,930 | B2 | 10/2020 | Schlichting | |
| 10,969,103 | B2 | 4/2021 | Chang et al. | |
| 11,015,812 | B2 | 5/2021 | Petty, Sr. et al. | |
| 2010/0236250 | A1 | 9/2010 | Headland et al. | |
| 2015/0260399 | A1 | 9/2015 | Low | |
| 2016/0245518 | A1 | 8/2016 | Drake | |
| 2018/0094817 | A1* | 4/2018 | Proscia | F23R 3/346 |
| 2018/0266689 | A1* | 9/2018 | Kramer | F23R 3/06 |
| 2018/0292090 | A1 | 10/2018 | Dyer et al. | |
| 2018/0306113 | A1 | 10/2018 | Morton et al. | |
| 2020/0003417 | A1* | 1/2020 | Schlichting | F23R 3/06 |
| 2020/0116360 | A1 | 4/2020 | White et al. | |
| 2020/0348023 | A1 | 11/2020 | Paauwe et al. | |
| 2021/0018178 | A1 | 1/2021 | Sze | |
| 2021/0102705 | A1 | 4/2021 | Kramer | |
| 2021/0325043 | A1 | 10/2021 | Freeman et al. | |

FOREIGN PATENT DOCUMENTS

| | | | |
|---|---|---|---|
| EP | 2868973 | B1 | 12/2018 |
| EP | 3770500 | A1 | 1/2021 |
| EP | 3321586 | B1 | 6/2021 |
| GB | 2432902 | B | 1/2011 |

* cited by examiner

COMBUSTOR CHAMBER MESH STRUCTURE

CROSS REFERENCE TO RELATED APPLICATIONS

The present application claims the benefit of Indian Patent Application No. 202211027571, filed on May 13, 2022, which is hereby incorporated by reference herein in its entirety.

TECHNICAL FIELD

The present disclosure relates generally to combustor liners and, in particular, to clips for coupling a combustor liner to a skeleton mesh structure of a combustor.

BACKGROUND

A gas turbine engine generally includes a fan and a core arranged in flow communication with one another, with the core disposed downstream of the fan in a direction of flow through the gas turbine engine. The core of the gas turbine engine generally includes, in serial flow order, a compressor section, a combustion section, a turbine section, and an exhaust section. With multi-shaft gas turbine engines, the compressor section can include a high pressure compressor (HPC) disposed downstream of a low pressure compressor (LPC), and the turbine section can similarly include a low pressure turbine (LPT) disposed downstream of a high pressure turbine (HPT). With such a configuration, the HPC is coupled with the HPT via a high pressure shaft (HPS), and the LPC is coupled with the LPT via a low pressure shaft (LPS). In operation, at least a portion of air over the fan is provided to an inlet of the core. Such a portion of the air is progressively compressed by the LPC and, then, by the HPC until the compressed air reaches the combustion section. Fuel is mixed with the compressed air and burned within the combustion section to produce combustion gases. The combustion gases are routed from the combustion section through the HPT and, then, through the LPT. The flow of combustion gases through the turbine section drives the HPT and the LPT, each of which in turn drives a respective one of the HPC and the LPC via the HPS and the LPS. The combustion gases are then routed through the exhaust section, e.g., to atmosphere. The LPT drives the LPS, which drives the LPC. In addition to driving the LPC, the LPS can drive the fan through a power gearbox, which allows the fan to be rotated at fewer revolutions per unit of time than the rotational speed of the LPS, for greater efficiency.

The fuel that mixed with the compressed air and burned within the combustion section is delivered through a fuel nozzle.

BRIEF DESCRIPTION OF THE DRAWINGS

The foregoing and other features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Additional features, advantages, and embodiments of the present disclosure are set forth or apparent from a consideration of the following detailed description, drawings, and claims. Moreover, it is to be understood that both the foregoing summary of the present disclosure and the following detailed description are exemplary and intended to provide further explanation without limiting the scope of the disclosure as claimed.

Various embodiments of the present disclosure are discussed in detail below. While specific embodiments are discussed, this is done for illustration purposes only. A person skilled in the relevant art will recognize that other components and configurations may be used without departing from the spirit and the scope of the present disclosure.

In the following specification and the claims, reference may be made to a number of "optional" or "optionally" elements meaning that the subsequently described event or circumstance may occur or may not occur, and that the description includes instances in which the event occurs and instances in which the event does not occur.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged. Such ranges are identified and include all the sub-ranges contained therein unless context or language indicates otherwise.

As used herein, the terms "axial" and "axially" refer to directions and orientations that extend substantially parallel to a centerline of the turbine engine or the combustor. Moreover, the terms "radial" and "radially" refer to directions and orientations that extend substantially perpendicular to the centerline of the turbine engine or the fuel-air mixer assembly. In addition, as used herein, the terms "circumferential" and "circumferentially" refer to directions and orientations that extend arcuately about the centerline of the turbine engine or the fuel-air mixer assembly.

Figure 1:
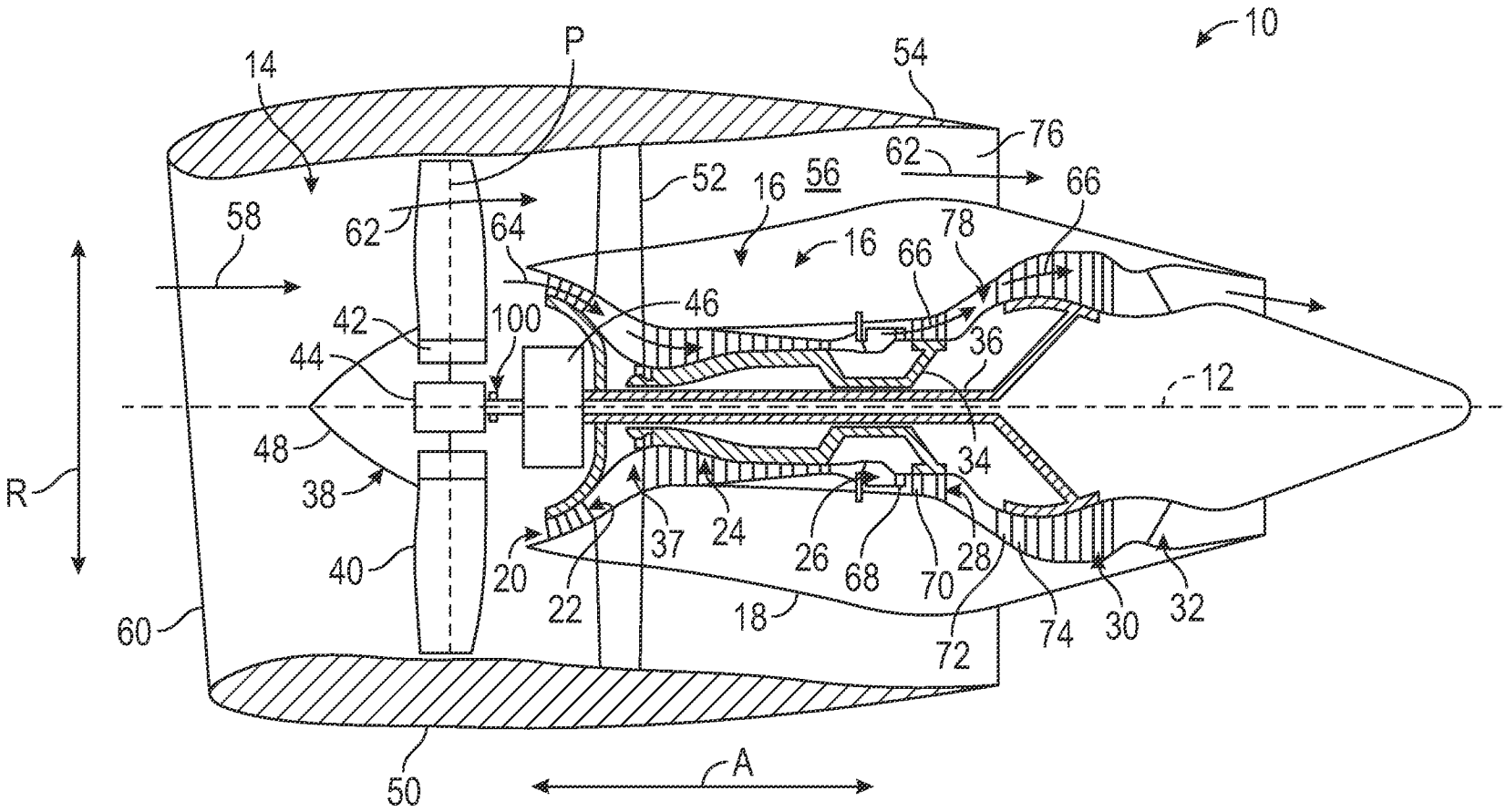
FIG. 1 is a schematic cross-sectional diagram of a turbine engine, according to an embodiment of the present disclosure.

As will be further described in detail in the following paragraphs, a combustor is provided with improved liner durability under a harsh heat and stress environment. The combustor includes a skeleton mesh structure (also referred to as a hanger or a truss) on which are mounted an inner liner and outer liner. The skeleton mesh structure acts as a supporting structure for the inner liner and the outer liner as whole. In an embodiment, the skeleton mesh structure can be made of metal. The skeleton mesh structure, together with the inner liner and the outer liner, define the combustion chamber. The inner liner and the outer liner include a plurality of hot side planks. The plurality of hot side planks cover at least the hot side of the skeleton mesh structure. In an embodiment, the plurality of hot side planks can be made of a ceramic material, a Ceramic Matrix Composite (CMC) material, or a metal coated with CMC or thermal barrier coating (TBC). In an embodiment, the plurality hot side planks are exposed to hot flames. A connection interface of the plurality of hot side planks to the skeleton mesh structure can be configured to be thermally expansion tolerant. Furthermore, the plurality of hot side planks coupled to the skeleton mesh structure interface can be configured to improve performance in terms of reducing air leakage to a very minimal value or substantially eliminating the air leakage, so that the interface does not impact aerodynamics for NOR/thermal field and film cooling. The interface between the plurality of hot side planks and the skeleton mesh structure can be an inverted "S" shape interface, a tapered interface, a step-like interface hanger free axial bolts on clips, variable clips with axial bolts for stress relief and to accommodate thermal growth, etc. The skeleton mesh structure together with the plurality of hot side planks can improve durability by reducing or substantially eliminating hoop stress while providing a lightweight liner configuration for the combustor (greater than twenty percent weight reduction can be achieved). In addition, the use of the plurality of hot side planks together with the skeleton mesh structure having the louvers provides a modular or segmented configuration that facilitates manufacturing and/or inspection, servicing and replacement of individual planks and/or louvers FIG. 1 is a schematic cross-sectional diagram of a turbine engine 10, according to an embodiment of the present disclosure. More particularly, for the embodiment shown in FIG. 1, the turbine engine 10 is a high-bypass turbine engine. As shown in FIG. 1, the turbine engine 10 defines an axial direction A (extending parallel to a longitudinal centerline 12 provided for reference) and a radial direction R, generally perpendicular to the axial direction A. The turbine engine 10 includes a fan section 14 and a core turbine engine 16 disposed downstream from the fan section 14. The term "downstream" is used herein with reference to air flow direction 58.

The core turbine engine 16 depicted generally includes an outer casing 18 that is substantially tubular and that defines an annular inlet 20. The outer casing 18 encases, in serial flow relationship, a compressor section including a booster or a low pressure compressor (LPC) 22 and a high pressure compressor (HPC) 24, a combustion section 26, a turbine section including a high pressure turbine (HPT) 28 and a low pressure turbine (LPT) 30, and a jet exhaust nozzle section 32. A high pressure shaft (HPS) 34 drivingly connects the HPT 28 to the HPC 24. A low pressure shaft (LPS) 36 drivingly connects the LPT 30 to the LPC 22. The compressor section, the combustion section 26, the turbine section, and the jet exhaust nozzle section 32 together define a core air flow path 37.

For the embodiment depicted, the fan section 14 includes a fan 38 with a variable pitch having a plurality of fan blades 40 coupled to a disk 42 in a spaced apart manner. As depicted, the fan blades 40 extend outwardly from the disk 42, generally along the radial direction R. Each fan blade 40 is rotatable relative to the disk 42 about a pitch axis P by virtue of the fan blades 40 being operatively coupled to a suitable actuation member 44 that is configured to collectively vary the pitch of the fan blades 40 in unison. The fan blades 40, the disk 42, and the actuation member 44 are together rotatable about the longitudinal centerline 12 (longitudinal axis) by the LPS 36 across a power gear box 46. The power gear box 46 includes a plurality of gears for adjusting or controlling the rotational speed of the fan 38 relative to the LPS 36 to a more efficient rotational fan speed.

The disk 42 is covered by a rotatable front hub 48 aerodynamically contoured to promote an air flow through the plurality of fan blades 40. Additionally, the fan section 14 includes an annular fan casing or a nacelle 50 that circumferentially surrounds the fan 38 and/or at least a portion of the core turbine engine 16. The nacelle 50 may be configured to be supported relative to the core turbine engine 16 by a plurality of circumferentially-spaced outlet guide vanes 52. Moreover, a downstream section 54 of the nacelle 50 may extend over an outer portion of the core turbine engine 16 so as to define a bypass air flow passage 56 therebetween.

During operation of the turbine engine 10, a volume of air flow 58 enters the turbine engine 10 in air flow direction 58 through an associated inlet 60 of the nacelle 50 and/or the fan section 14. As the volume of air passes across the fan blades 40, a first portion of the air, as indicated by arrows 62, is directed or routed into the bypass air flow passage 56 and a second portion of the air, as indicated by arrow 64, is directed or routed into the core air flow path 37, or, more specifically, into the LPC 22. The ratio between the first portion of air indicated by arrows 62 and the second portion of air indicated by arrows 64 is commonly known as a bypass ratio. The pressure of the second portion of air, indicated by arrows 64, is then increased as it is routed through the HPC 24 and into the combustion section 26, where it is mixed with fuel and burned to provide combustion gases 66.

The combustion gases 66 are routed through the HPT 28 where a portion of thermal energy and/or kinetic energy from the combustion gases 66 is extracted via sequential stages of HPT stator vanes 68 that are coupled to the outer casing 18 and HPT rotor blades 70 that are coupled to the HPS 34, thus, causing the HPS 34 to rotate, thereby supporting operation of the HPC 24. The combustion gases 66 are then routed through the LPT 30 where a second portion of thermal and kinetic energy is extracted from the combustion gases 66 via sequential stages of LPT stator vanes 72 that are coupled to the outer casing 18 and LPT rotor blades 74 that are coupled to the LPS 36, thus, causing the LPS 36 to rotate, thereby supporting operation of the LPC 22 and/or rotation of the fan 38.

The combustion gases 66 are subsequently routed through the jet exhaust nozzle section 32 of the core turbine engine 16 to provide propulsive thrust. Simultaneously, the pressure of the first portion of air 62 is substantially increased as the first portion of air 62 is routed through the bypass air flow passage 56 before it is exhausted from a fan nozzle exhaust section 76 of the turbine engine 10, also providing propulsive thrust. The HPT 28, the LPT 30, and the jet exhaust nozzle section 32 at least partially define a hot gas path 78 for routing the combustion gases 66 through the core turbine engine 16.

The turbine engine 10 depicted in FIG. 1 is, however, by way of example only. In other exemplary embodiments, the turbine engine 10 may have any other suitable configuration. In still other exemplary embodiments, aspects of the present disclosure may be incorporated into any other suitable gas turbine engine. For example, in other exemplary embodiments, aspects of the present disclosure may be incorporated into, e.g., a turboshaft engine, a turboprop engine, a turbocore engine, a turbojet engine, etc.

Figure 2A:
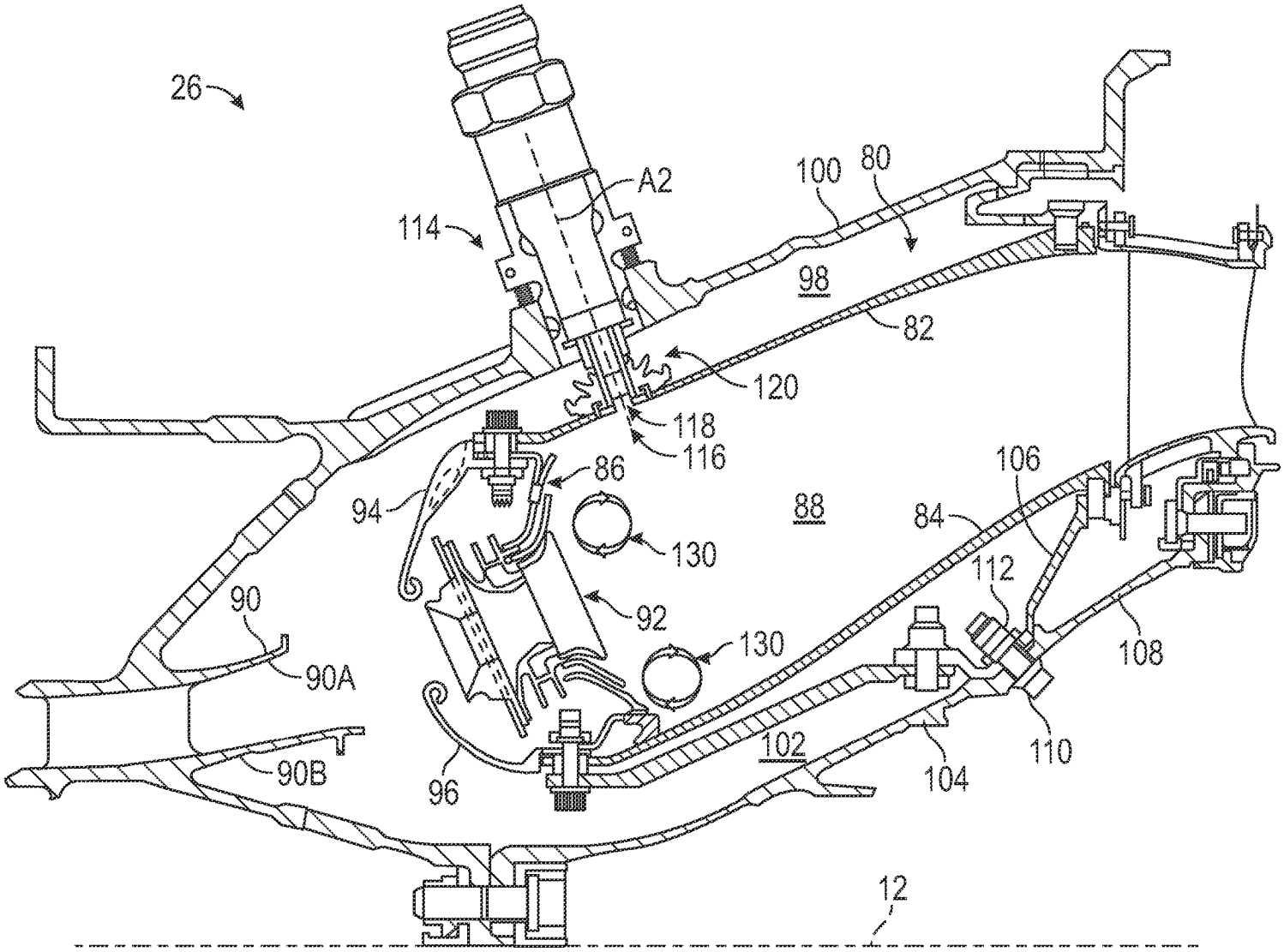
FIG. 2A is a schematic longitudinal cross-sectional view of the combustion section of the turbine engine of FIG. 1, according to an embodiment of the present disclosure.

FIG. 2A is a schematic, cross-sectional view of the combustion section 26 of the turbine engine 10 of FIG. 1, according to an embodiment of the present disclosure. The combustion section 26 generally includes a combustor 80 that generates the combustion gases discharged into the turbine section, or, more particularly, into the HPT 28. The combustor 80 includes an outer liner 82, an inner liner 84, and a dome 86. The outer liner 82, the inner liner 84, and the dome 86 together define a combustion chamber 88 that extends around the turbine centerline 12. In addition, a diffuser 90 is positioned upstream of the combustion chamber 88. The diffuser 90 has an outer diffuser wall 90A and an inner diffuser wall 90B. The inner diffuser wall 90B is closer to a longitudinal centerline 12. The diffuser 90 receives an air flow from the compressor section and provides a flow of compressed air to the combustor 80. In an embodiment, the diffuser 90 provides the flow of compressed air to a single circumferential row of fuel/air mixers 92. In an embodiment, the dome 86 of the combustor 80 is configured as a single annular dome, and the circumferential row of fuel/air mixers 92 are provided within openings formed in the dome 86 (air feeding dome or combustor dome). However, in other embodiments, a multiple annular dome can also be used.

In an embodiment, the diffuser 90 can be used to slow the high speed, highly compressed air from a compressor (not shown) to a velocity optimal for the combustor. Furthermore, the diffuser 90 can also be configured to limit the flow distortion as much as possible by avoiding flow effects like boundary layer separation. Similar to most other gas turbine engine components, the diffuser 90 is generally designed to be as light as possible to reduce weight of the overall engine.

A fuel nozzle (not shown) provides fuel to fuel/air mixers 92 depending upon a desired performance of the combustor 80 at various engine operating states. In the embodiment shown in FIG. 2A, an outer cowl 94 (e.g., an annular cowl) and an inner cowl 96 (e.g., an annular cowl) are located upstream of the combustion chamber 88 so as to direct air flow into fuel/air mixers 92. The outer cowl 94 and the inner cowl 96 may also direct a portion of the flow of air from the diffuser 90 to an outer passage 98 defined between the outer liner 82 and an outer casing 100 and an inner passage 102 defined between the inner liner 84 and an inner casing 104. In addition, an inner support cone 106 is further shown as being connected to a nozzle support 108 using a plurality of bolts 110 and nuts 112. Other combustion sections, however, may include any other suitable structural configuration.

The combustor 80 is also provided with an igniter 114. The igniter 114 is provided to ignite the fuel/air mixture supplied to combustion chamber 88 of the combustor 80. The igniter 114 is attached to the outer casing 100 of the combustor 80 in a substantially fixed manner. Additionally, the igniter 114 extends generally along an axial direction A2, defining a distal end 116 that is positioned proximate to an opening in a combustor member of the combustion chamber 88. The distal end 116 is positioned proximate to an opening 118 within the outer liner 82 of the combustor 80 to the combustion chamber 88.

In an embodiment, the dome 86 of the combustor 80, together with the outer liner 82, the inner liner 84, and the fuel/air mixers 92, forms the combustion chamber provide a swirling flow 130. The air flows through the fuel/air mixers 92 as the air enters the combustion chamber 88. The role of the dome 86 and the fuel/air mixers 92 is to generate turbulence in the air flow to rapidly mix the air with the fuel. The swirler (also called a mixer) establishes a local low pressure zone that forces some of the combustion products to recirculate, as illustrated in FIG. 2, creating needed high turbulence.

Figure 2B:
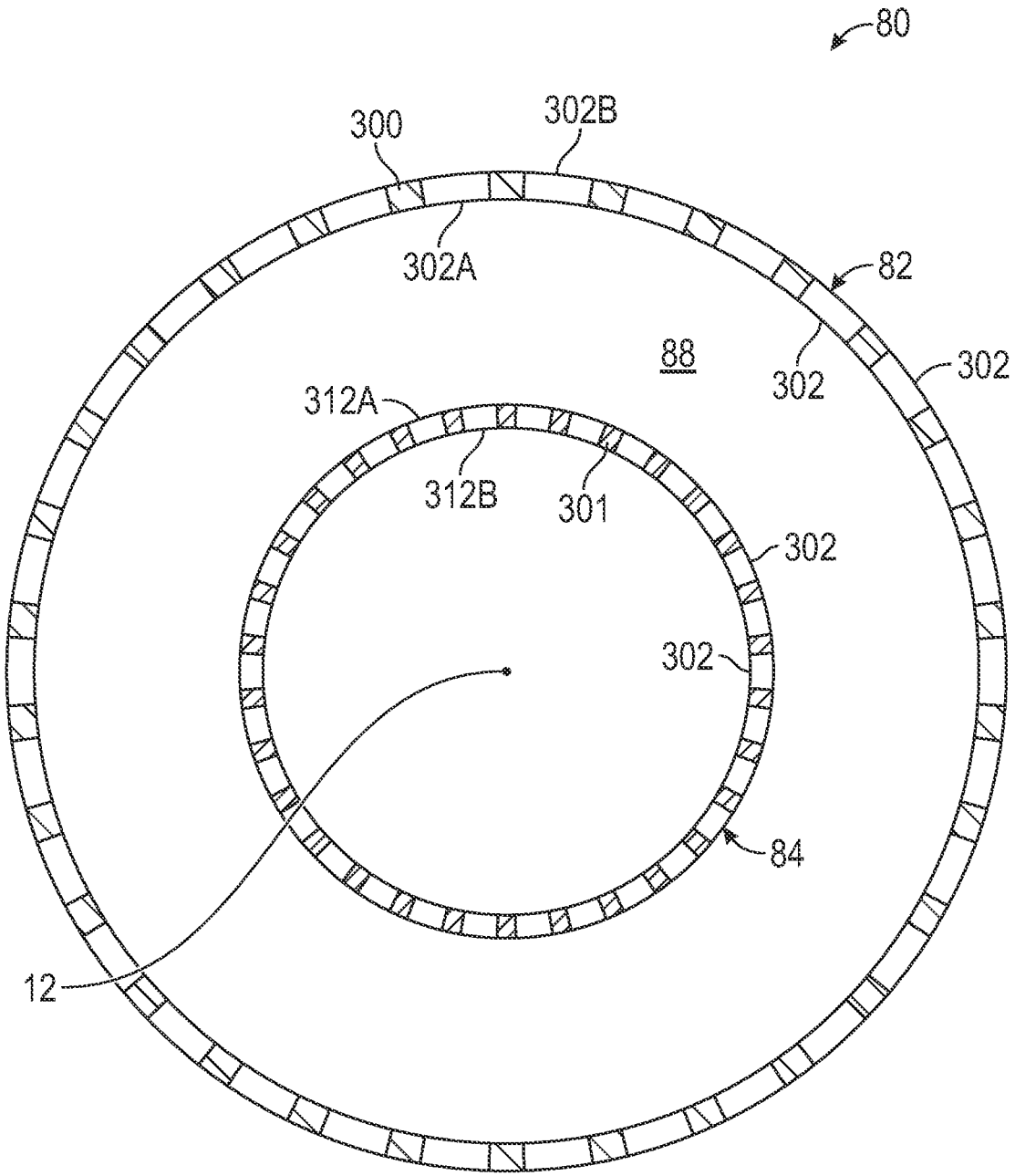
FIG. 2B is a schematic transversal cross-sectional view of the combustor of the turbine engine of FIG. 1, according to an embodiment of the present disclosure.

FIG. 2B is a schematic transversal cross-sectional view of the combustor 80 of the turbine engine 10 of FIG. 1, according to an embodiment of the present disclosure. The combustor 80 includes the outer liner 82 and the inner liner 84 which extend around the turbine centerline 12 to define the combustion chamber 88. The outer liner 82 includes a outer mesh structure 300 (also referred to as a hanger or a truss) and a plurality of hot side planks 302A and a plurality of cold side planks 302B. The plurality of hot side planks 302A and the plurality of cold side planks 302B are mounted to the outer mesh structure 300 (outer mesh structure) of the outer liner 82. The inner liner 84 includes the inner mesh structure 301 (inner mesh structure) and a plurality of hot side planks 312A and a plurality of cold side planks 312B. The plurality of hot side planks 312A and the plurality of cold side planks 312B are mounted to the inner mesh structure 301 of the inner liner 84. The outer mesh structure 300 acts as a supporting structure for the hot side planks 302A and the cold side planks 302B of the outer liner 82. The inner mesh structure 301 acts as a supporting structure for the hot side planks 312A and the cold side planks 312B of the inner liner 84. In an embodiment, the outer mesh structure 300 and the inner mesh structure 301 are made of metal.

The plurality of hot side planks 302A are mounted to and cover the hot side of the outer mesh structure 300, and the cold side planks 302B are mounted to and cover the cold side of the outer mesh structure 300. In this regard, the plurality of hot side planks 302A and the plurality of cold side planks 302B may be sized and shaped to mesh or connect together and have abutting edges without gaps between adjacent planks 302A, 302B. In other embodiments, gaps may be provided between adjacent planks 302A, 302B. The plurality of hot side planks 312A are mounted to and cover the hot side of the inner mesh structure 301, and the cold side planks 312B are mounted to and cover the cold side of the inner mesh structure 301. In this regard, the plurality of hot side planks 312A and the plurality of cold side planks 312B may be sized and shaped to mesh or connect together and have abutting edges without gaps between adjacent planks 312A, 312B. In other embodiments, gaps may be provided between adjacent planks 312A, 312B. The plurality of hot side planks 302A of the outer liner 82 and the plurality of hot side planks 312A of the inner liner 84 are exposed to hot flames within the combustion chamber 88. In an embodiment, the plurality of hot side planks 302A, 312A are made of ceramic or are made of metal coated with a ceramic coating or thermal barrier coating to enhance resistance to relatively high temperatures. In an embodiment, the plurality of hot side planks 302A, 312A can be made of a ceramic material, a Ceramic Matrix Composite (CMC) material, or a metal coated with CMC or thermal barrier coating (TBC). In an embodiment, the cold side planks 302B, 312B can be made of a metal or a Ceramic Matrix Composite (CMC). In an embodiment, the cold side planks 302B, 312B are thinner than the plurality of hot side planks 302A, 312A. In an embodiment, as shown in FIG. 2B, both the inner liner 84 and the outer liner 82 are shown having the plurality of hot side planks 302A, 312A and the plurality of cold side planks 302B, 312B. In another embodiment, the plurality of cold side planks 302B, 312B may be optional for the outer liner 82, for the inner liner 84, or for both. The hot side of the inner mesh structure 301 faces and/or is adjacent to the combustion chamber 88, and the cold side of the inner mesh structure 301 faces and/or is adjacent to the inner passage 102 surrounding the liner, shown in FIG. 2A. The hot side of the outer mesh structure 300 faces and/or is adjacent to the combustion chamber 88, and the cold side of the outer mesh structure 300 faces and/or is adjacent to the outer passage 98 surrounding the liner, shown in FIG. 2A.

Figure 3:
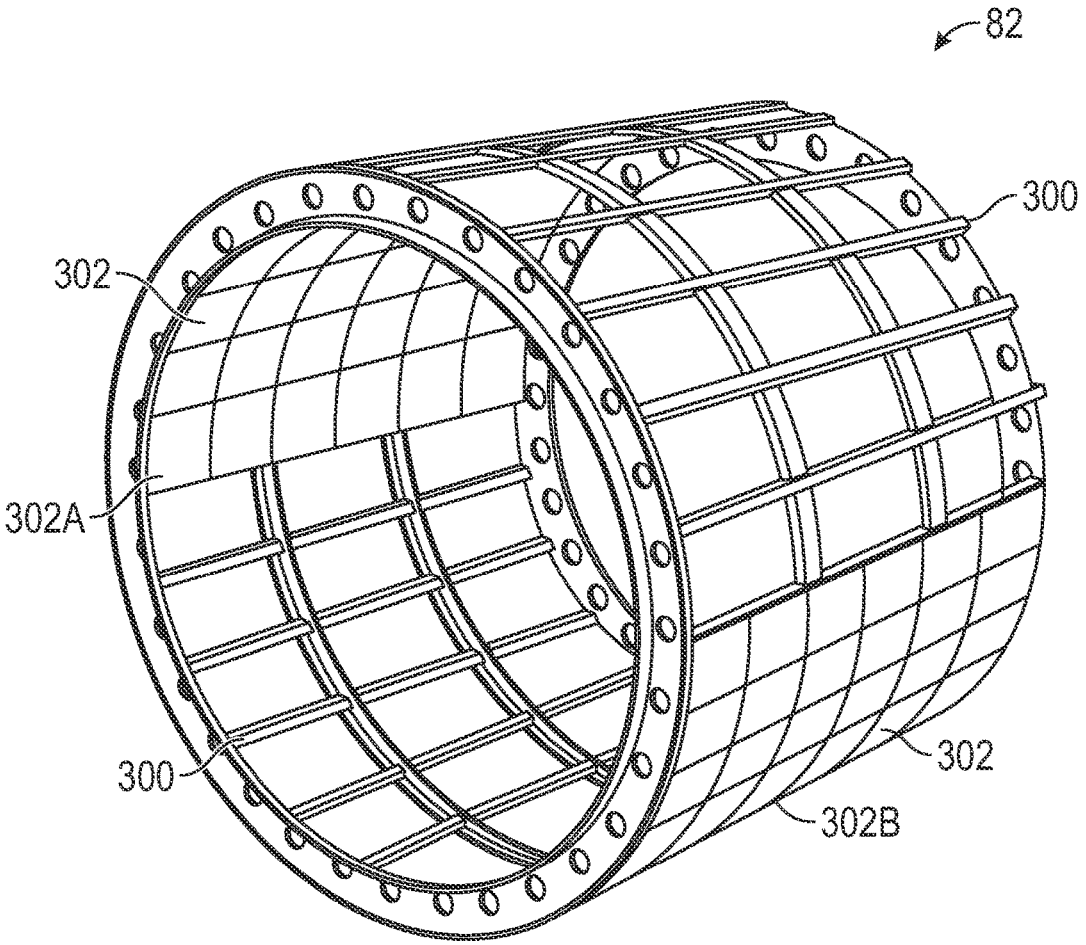
FIG. 3 is a schematic perspective view of an outer liner of the combustor, according to an embodiment of the present disclosure.

FIG. 3 is a schematic perspective view of the outer liner 82 of the combustor 80, according to an embodiment of the present disclosure. In FIG. 3, only the outer liner 82 is shown and the inner liner 84 is omitted in this figure for clarity purposes. The outer liner 82 is shown having generally a cylindrical configuration. The inner liner 84 is similar in many aspects to the outer liner 82. However, the inner liner 84 has a radius of curvature smaller than a radius of curvature of the outer liner 82. As shown in FIG. 3, the outer liner 82 comprises the outer mesh structure 300 (outer mesh structure) on which are mounted the plurality of hot side planks 302A and the plurality of cold side planks 302B. The plurality of hot side planks 302A and the plurality of cold side planks 302B are mounted to the outer mesh structure 300 of the outer liner 82. The outer mesh structure 300 acts as a supporting structure for the hot side planks 302A and the cold side planks 302B of the outer liner 82. In an embodiment, the outer mesh structure 300 is made of metal. The plurality of hot side planks 302A are mounted to and cover the hot side of the outer mesh structure 300, and the cold side planks 302B are mounted to and cover the cold side of the outer mesh structure 300. In this regard, as depicted in FIG. 3, the plurality of hot side planks 302A and the plurality of cold side planks 302B may be sized and shaped to mesh together, and have abutting edges without gaps between adjacent planks 302A and 302B. In other embodiments, gaps may be provided between adjacent planks 302A and 302B.

The outer mesh structure 300 together with the plurality of hot side planks 302A and the plurality of cold side planks 302B can improve durability due to hoop stress reduction or elimination while providing a lightweight liner configuration for the combustor 80. Similarly, the inner mesh structure 301 together with the plurality of hot side planks 312A and the plurality of cold side planks 312B can improve durability due to hoop stress reduction or elimination while providing a lightweight liner configuration for the combustor 80. For example, the present configuration provides at least twenty percent weight reduction as compared to conventional combustors. Furthermore, the present configuration provides the additional benefit of being modular or segmented and, thus, relatively easy to repair. Indeed, if one or more planks in the plurality of hot side planks 302A, 312A or the plurality of cold side planks 302B, 312B is damaged, only the damaged one or more planks is replaced and not the entire inner liner 84 or the entire outer liner 82. Furthermore, the present configuration lends itself to be relatively easy to inspect and to repair. All these benefits result in overall cost savings.

Figure 4:
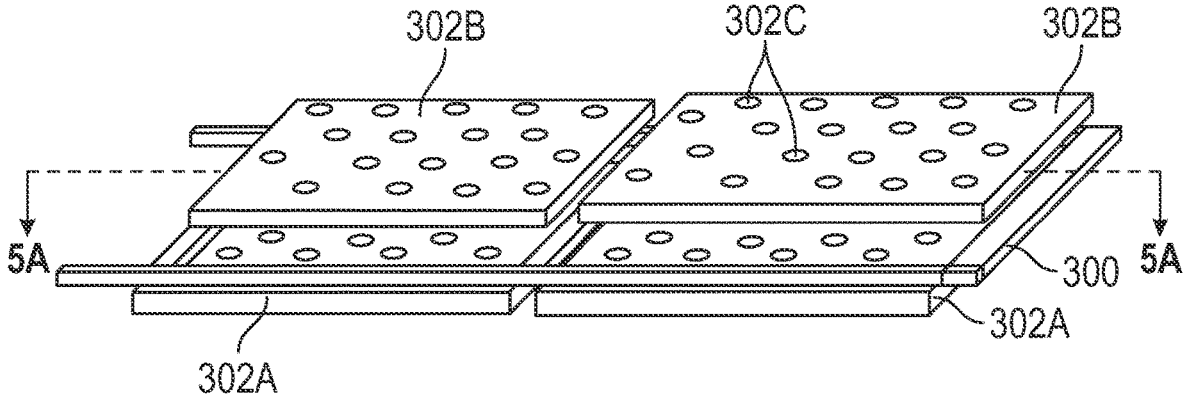
FIG. 4 is a schematic perspective view of a section of an inner liner and an outer liner of the combustor, according to an embodiment of the present disclosure.

FIG. 4 is a schematic perspective view of a section of the inner liner 84 and the outer liner 82 of the combustor 80, according to an embodiment of the present disclosure. As shown in FIG. 4, the plurality of hot side planks 302A and the plurality of cold side planks 302B are mounted to the outer mesh structure 300. The plurality of hot side planks 302A and the plurality of cold side planks 302B include a plurality of holes 302C. As shown in FIG. 4, the plurality of hot side planks 302A and the plurality of cold side planks 302B are mounted on opposite sides of the outer mesh structure 300. The plurality of holes 302C are distributed along a surface of the plurality of hot side planks 302A and a plurality of cold side planks 302B to allow air to enter to the combustion chamber 88 and/or to allow air to circulate within a gap between the plurality of hot side planks 302A and the cold side planks 302B. Although, the outer liner 82 is discussed herein with respect to FIG. 4, the same description can also be applied to the inner liner 84.

Figure 5A:
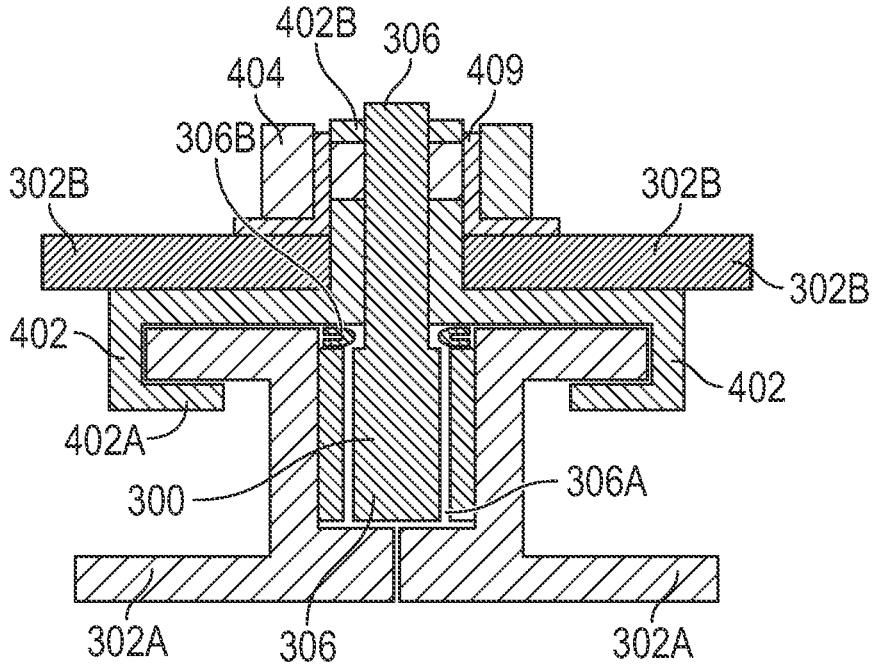
FIG. 5A is a schematic cross-sectional view of one of the plurality of hot side planks mounted to a structural element of the skeleton mesh structure, at cross-sectional line 5A-5A shown in FIG. 4, according to an embodiment of the present disclosure.

FIG. 5A is a schematic cross-sectional view of one of the plurality of hot side planks 302A mounted to a structural element 306 of the outer mesh structure 300, at cross-sectional line 5A-5A shown in FIG. 4, according to an embodiment of the present disclosure. As shown in FIG. 5A, the outer mesh structure 300 can include the plurality of structural elements 306 that are connected together to form the outer mesh structure 300 shown in FIGS. 3 and 4. A plurality of clips 402 are provided to couple the plurality of hot side planks 302A and the plurality of cold side planks 302B to the plurality of structural elements 306. The plurality of hot side planks 302A are coupled to the plurality of clips 402 that are, in turn, coupled to the plurality of structural elements 306. The plurality of clips 402 have a first end 402A (inner clamping structure) that couples directly to the hot side plank 302A. The first end 402A of the plurality of clips 402 is coupled to the plurality of hot side planks 302A. A second end 402B (outer clamping structure) of the plurality of clips 402 is coupled to the plurality of structural elements 306 using a plurality of fasteners 404. The plurality of cold side planks 302B are mounted or coupled to the plurality of clips 402. A plurality of holding members 409 (e.g., L-shaped clips) are used to push on against the plurality of cold side planks 302B and sandwich the plurality of cold side planks 302B between the plurality of clips 402 and the plurality of holding members 409 to hold the plurality of cold side planks 302B. The fasteners 404 are used to couple the plurality of holding members 409 to the plurality of clips 402 and to the structural elements 306. As shown in FIG. 5A, the plurality of structural elements 306 can include a plurality of channels 306A. A plurality of resilient seal members 306B (e.g., C-springs) can be provided between the plurality of structural elements 306 and the plurality of clips 402.

Figure 5B:
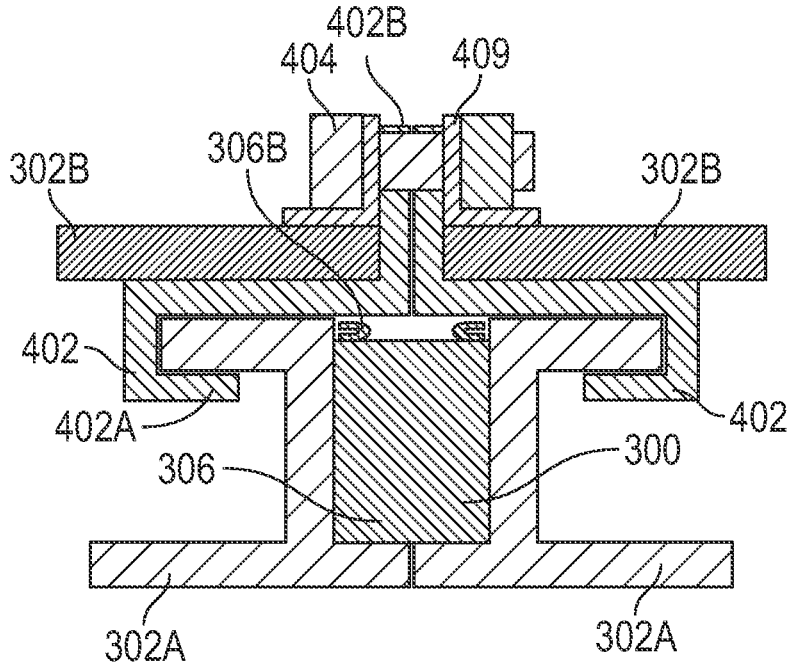
FIG. 5B is a schematic cross-sectional view of one of the plurality of hot side planks mounted to a structural element of the skeleton mesh structure, according to another embodiment of the present disclosure.

FIG. 5B is a schematic cross-sectional view of one of the plurality of hot side planks 302A mounted to a structural element 306 of the outer mesh structure 300, according to another embodiment of the present disclosure. As shown in FIG. 5B, similar to the embodiment shown in FIG. 5A, the plurality of hot side planks 302A are coupled to a plurality of clips 402. As shown in FIG. 5B, the plurality of hot side planks 302A are also coupled to the plurality of structural elements 306. The plurality of clips 402 have a first end 402A (inner clamping structure). The first end 402A of the plurality of clips 402 is coupled to the plurality of hot side planks 302A. The second end 402B (outer clamping structure) of the plurality of clips 402 is coupled to the plurality of fasteners 404. The plurality of cold side planks 302B are mounted to the plurality of clips 402. The plurality of holding members 409 are used to push the plurality of cold side planks 302B against the plurality of clips 402 to hold the plurality of cold side planks 302B. The fasteners 404 are used to couple the plurality of holding members 409 to the plurality of clips 402. The plurality of resilient seal members 306B (e.g., C-springs) can be provided between the plurality of structural elements 306 and the plurality of clips 402. A main difference between the embodiment shown in FIG. 5A and the embodiment shown in FIG. 5B is that, in the embodiment shown in FIG. 5A, the plurality of structural elements 306 extend and are directly coupled to the plurality of clips 402 using the plurality of fasteners 404, whereas, in the embodiment shown in FIG. 5B the plurality of structural elements 306 are not directly coupled to the plurality of clips 402. The configuration shown in FIG. 5A is called generally "axial bolts on clips on hanger." Whereas the configuration shown in FIG. 5B is called "hanger free axial bolts on clips."

Figure 6A:
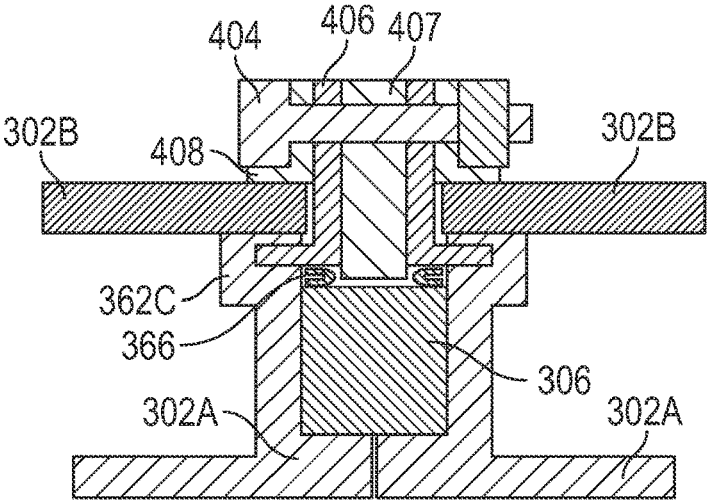
FIG. 6A is a schematic cross-sectional view of one of the plurality of hot side planks mounted to a structural element of the skeleton mesh structure, according to another embodiment of the present disclosure.

FIG. 6A is a schematic cross-sectional view of one of the plurality of hot side planks 302A mounted to a structural element 306 of the outer mesh structure 300, according to another embodiment of the present disclosure. As shown in FIG. 6A, the plurality of hot side planks 302A are coupled to a plurality of clips 406. The plurality of hot side planks 302A have an L-like shape with a C-notch 362C. In an embodiment, the plurality of clips 406 have an L-shape. The C-notch 362C of the plurality of hot side planks 302A is configured to couple with corresponding arms in the L-shape of the plurality of clips 406. Each pair of the plurality of clips 406 is, in turn, coupled together using the fastener 404. A splitter sleeve 407 is provided as a spacer between each pair of the plurality of clips 406. The plurality of hot side planks 302A are also coupled to the plurality of structural elements 306. A plurality of seals 366 (e.g., C-seals) can be provided at an interface between the plurality of structural elements 306 and the plurality of clips 406. As shown in FIG. 6A, the plurality of cold side planks 302B are mounted on the plurality of hot side planks 302A. The plurality of cold side planks 302B are mounted on the C-notch 362C of the plurality of hot side planks 302A. The plurality of holding member 408 are used to push the plurality of cold side planks 302B against the plurality of hot side planks 302A to hold the plurality of cold side planks 302B. The plurality of fasteners 404 are used to couple the plurality of holding members 408 to the plurality of clips 406. Each of the plurality of holding members 408 is sandwiched between each of the plurality of fasteners 404 and each of the plurality of clips 406.

Figure 6B:
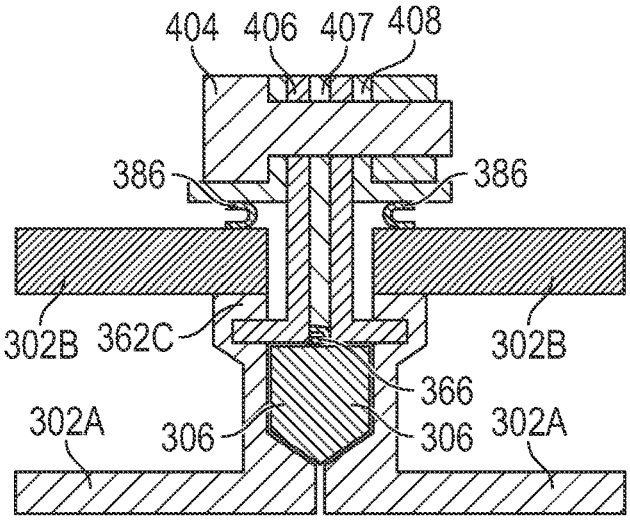
FIG. 6B is a schematic cross-sectional view of one of the plurality of hot side planks mounted to a structural element of the skeleton mesh structure, according to another embodiment of the present disclosure.

FIG. 6B is a schematic cross-sectional view of one of the plurality of hot side planks 302A mounted to a structural element 306 of the outer mesh structure 300, according to another embodiment of the present disclosure. The embodiment shown in FIG. 6B is similar in many aspects to the embodiment shown in FIG. 6A. As shown in FIG. 6B, the plurality of hot side planks 302A are coupled to a plurality of clips 406. The plurality of hot side planks 302A have an L-like shape with a C-notch 362C. In an embodiment, the plurality of clips 406 have an L-shape. The C-notch 362C of the plurality of hot side planks 302A is configured to couple with corresponding arms in the L-shape of the plurality of clips 406. Each pair of the plurality of clips 406 is, in turn, coupled together using the fastener 404. The splitter sleeve 407 is provided as a spacer between each pair of the plurality of clips 406. The plurality of hot side planks 302A are also coupled to the plurality of structural elements 306. In the embodiment, as shown in FIG. 6B, the plurality of structural elements 306 have a pointed shape that fits within a corresponding cavity formed by a pair of the plurality of hot side planks 302A. A plurality of seals 366 (e.g., C-seals) can be provided at an interface between the splitter sleeve 407 and the plurality of structural elements 306. As shown in FIG. 6B, the plurality of cold side planks 302B are mounted on the plurality of hot side planks 302A. The plurality of cold side planks 302B are mounted on the C-notch 362C of the plurality of hot side planks 302A. The plurality of holding members 408 are used to push the plurality of cold side planks 302B against the plurality of hot side planks 302A to hold the plurality of cold side planks 302B. The plurality of fasteners 404 are used to couple the plurality holding members 408 to the plurality of clips 406. Each of the plurality of holding members 408 is sandwiched between each of the plurality of fasteners 404 and each of the plurality of clips 406. A plurality of seals (e.g., C-seals) 386 are provided between the plurality of holding members 408 and the plurality of cold side planks 302B. Both the embodiments shown in FIGS. 6A and 6B are called "hanger free axial bolts on clips" because the plurality of the structural elements 306 are not directly connected to the plurality of fasteners 404.

Figure 6C:
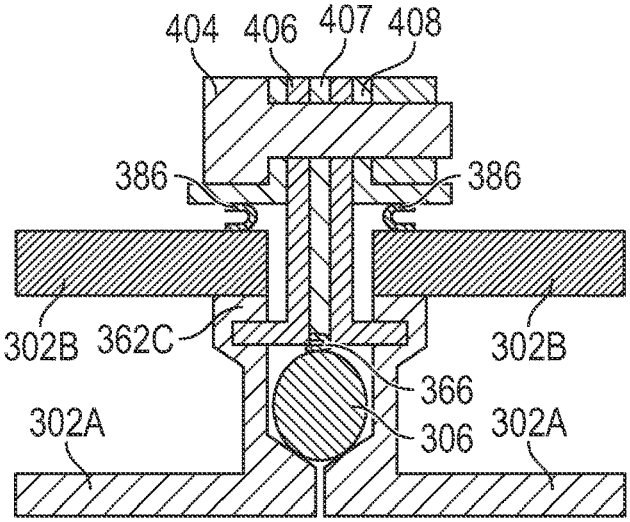
FIG. 6C is a schematic cross-sectional view of one of the plurality of hot side planks mounted to a structural element of the skeleton mesh structure, according to another embodiment of the present disclosure.

FIG. 6C is a schematic cross-sectional view of one of the plurality of hot side planks 302A mounted to a structural element 306 of the outer mesh structure 300, according to another embodiment of the present disclosure. The embodiment shown in FIG. 6C is similar in many aspects to the embodiment shown in FIG. 6B. One difference between the embodiment shown in FIG. C and the embodiment shown in FIG. 6B is that in FIG. 6B, the plurality of structural elements 306 have a pointed shape whereas in the embodiment shown in FIG. 6C the plurality of structural elements 306 have a round shape (e.g., a circular or an elliptical cross-sectional shape). As shown in FIG. 6C, the plurality of structural elements 306 have a round shape that fits within a corresponding cavity formed by a pair of the plurality of hot side planks 302A.

Figure 7A:
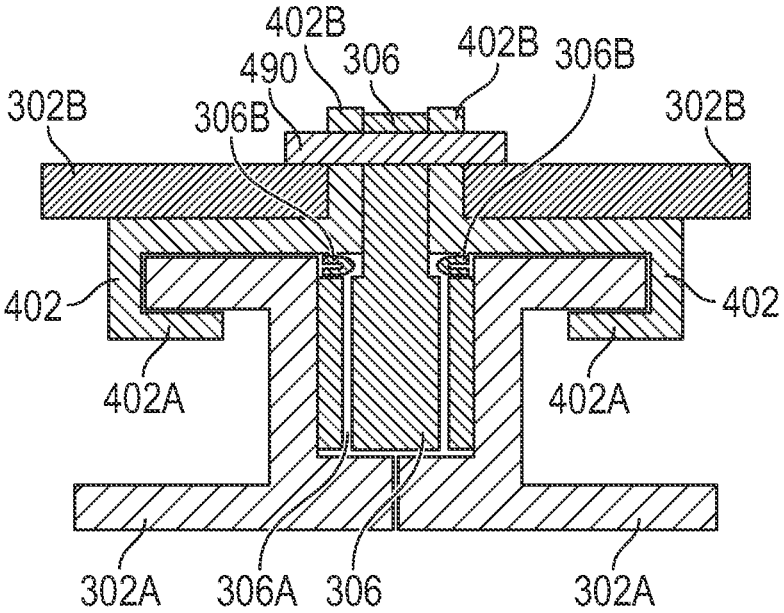
FIG. 7A is a schematic cross-sectional view of one of the plurality of hot side planks mounted to a structural element of the skeleton mesh structure, according to another embodiment of the present disclosure.

FIG. 7A is a schematic cross-sectional view of one of the plurality of hot side planks 302A mounted to a structural element 306 of the outer mesh structure 300, according to another embodiment of the present disclosure. As shown in FIG. 7A, the plurality of hot side planks 302A are coupled to a plurality of clips 402 that are, in turn, coupled to the plurality of structural elements 306. The plurality of clips 402 have a hook-like shape (e.g., a C-like shape). A first end 402A of the hook-like shape of the plurality of clips 402 is coupled to the plurality of hot side planks 302A. A second end 402B of the hook-like shape of the plurality of clips 402 is coupled to the plurality of structural elements 306 using a plurality of fasteners 490 (e.g., I-clips). Each of the plurality of fasteners 490 is inserted through a pair of the plurality of clips 402 and through one of the plurality structural elements 306 that is sandwiched between the pair of the plurality of clips 402. The plurality of cold side planks 302B are mounted to the plurality of clips 402. The plurality of fasteners 490 (e.g., I-clip) are configured to retain the plurality of cold side planks 302B against the plurality of clips 402. As shown in FIG. 5A, the plurality of structural elements 306 can include a plurality of channels 306A. A plurality of resilient seal members 306B (e.g., C-seals) can be provided between the plurality of structural elements 306 and the plurality of clips 402.

Figure 7B:
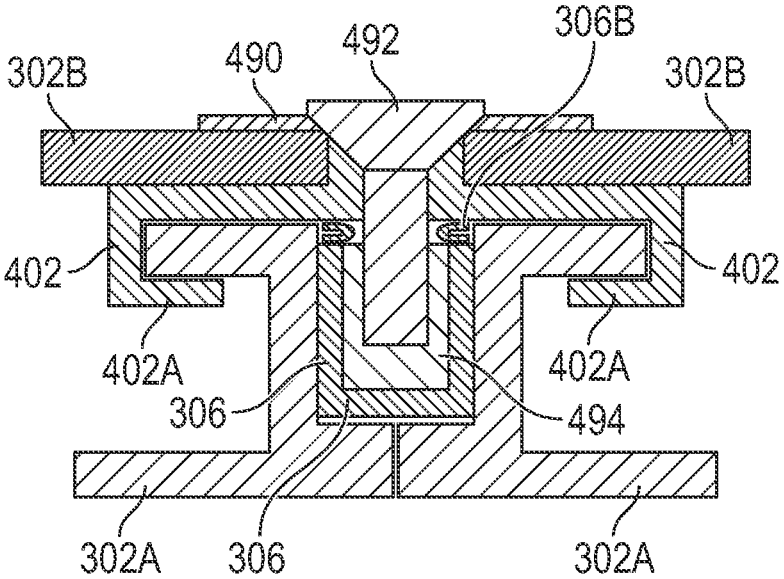
FIG. 7B is a schematic cross-sectional view of one of the plurality of hot side planks mounted to a structural element of the skeleton mesh structure, according to another embodiment of the present disclosure.

FIG. 7B is a schematic cross-sectional view of one of the plurality of hot side planks 302A mounted to a structural element 306 of the outer mesh structure 300, according to another embodiment of the present disclosure. As shown in FIG. 7B, the plurality of hot side planks 302A are coupled to a plurality of clips 402 that are, in turn, coupled to the plurality of structural elements 306. The plurality of clips 402 have a hook-like shape (e.g., a C-like shape). A first end 402A of the hook-like shape of the plurality of clips 402 is coupled to the plurality of hot side planks 302A. A second end 402B of the hook-like shape of the plurality of clips 402 is coupled to the plurality of structural elements 306 using a plurality fasteners 490 (e.g., I-clips). The plurality of cold side planks 302B are mounted to the plurality of clips 402. The plurality of fasteners 490 (e.g., I-clip) are configured to retain the plurality of cold side planks 302B against the plurality of clips 402. Each of the plurality of fasteners 490 is fastened using another fastener 492 (e.g., a screw) to each of the plurality of structural elements 306 via an insert member 494. As shown in FIG. 7B, a plurality of resilient seal members 306B (e.g., C-seals) can be provided between the plurality of structural elements 306 and the plurality of clips 402.

Figure 8A:
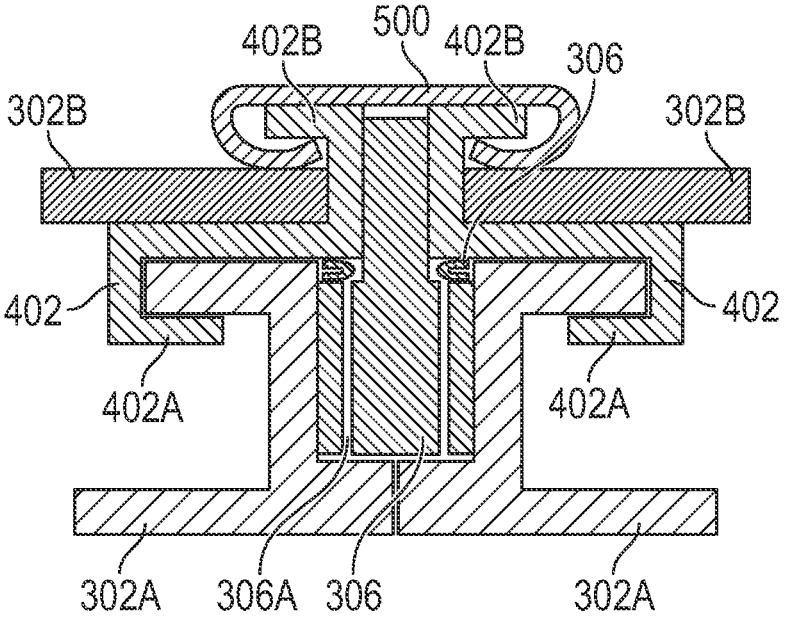
FIG. 8A is a schematic cross-sectional view of one of the plurality of hot side planks mounted to a structural element of the skeleton mesh structure, according to another embodiment of the present disclosure.

FIG. 8A is a schematic cross-sectional view of one of the plurality of hot side planks 302A mounted to a structural element 306 of the outer mesh structure 300, according to another embodiment of the present disclosure. As shown in FIG. 8A, the plurality of hot side planks 302A are coupled to a plurality of clips 402 that are, in turn, coupled to the plurality of structural elements 306. The plurality of clips 402 have a hook-like shape (e.g., an S-like shape). A first end 402A of the hook-like shape of the plurality of clips 402 is coupled to the plurality of hot side planks 302A. A second end 402B of the hook-like shape of the plurality of clips 402 is coupled to the plurality of structural elements 306 using a press clip 500. The press clip 500 presses on a pair of the plurality of clips 402 to bias the pair of the plurality of clips 402 against one of the plurality of structural elements 306. Each of the plurality of press clips 500 is inserted at the second end 402B of the pair of the plurality of clips 402. The plurality of cold side planks 302B are mounted to the plurality of clips 402. The plurality of press clips 500 are also configured to retain the plurality of cold side planks 302B against the plurality of clips 402 by pushing against a surface of the plurality of cold side planks. As shown in FIG. 8A, the plurality of structural elements 306 can include a plurality of channels 306A (cooling channels). A plurality of resilient seal members 306B (e.g., C-seals) can be provided between the plurality of structural elements 306 and the plurality of clips 402.

Figure 8B:
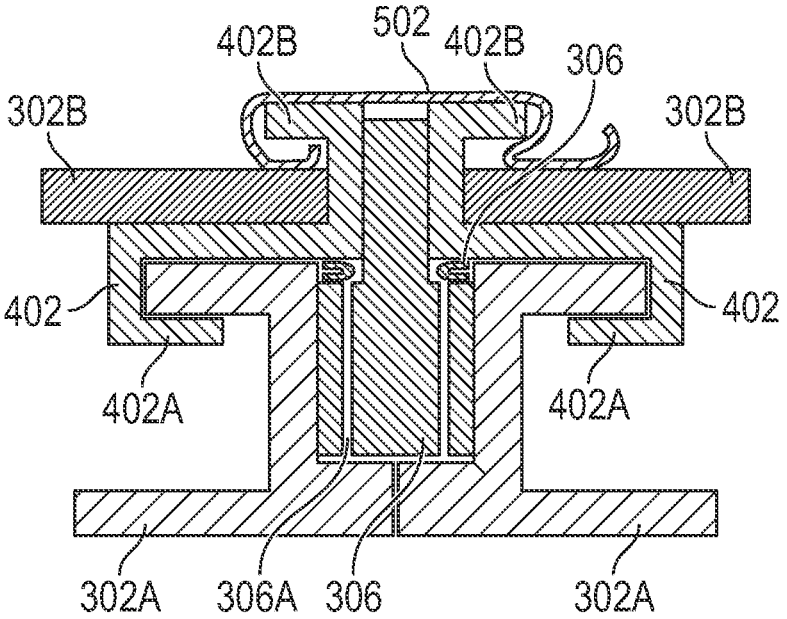
FIG. 8B is a schematic cross-sectional view of one of the plurality of hot side planks mounted to a structural element of the skeleton mesh structure, according to yet another embodiment of the present disclosure

FIG. 8B is a schematic cross-sectional view of one of the plurality of hot side planks 302A mounted to a structural element 306 of the outer mesh structure 300, according to another embodiment of the present disclosure. The embodiment shown in FIG. 8B is similar in many aspects to the embodiment shown in FIG. 8A. However, instead of the plurality of press clips 500, the embodiment shown in FIG. 8B uses a plurality of press clips 502. The plurality of press clips 502 are a different type of press clips that has an edge for easy and quick detachment from the plurality of clips 402.

Figure 9A:
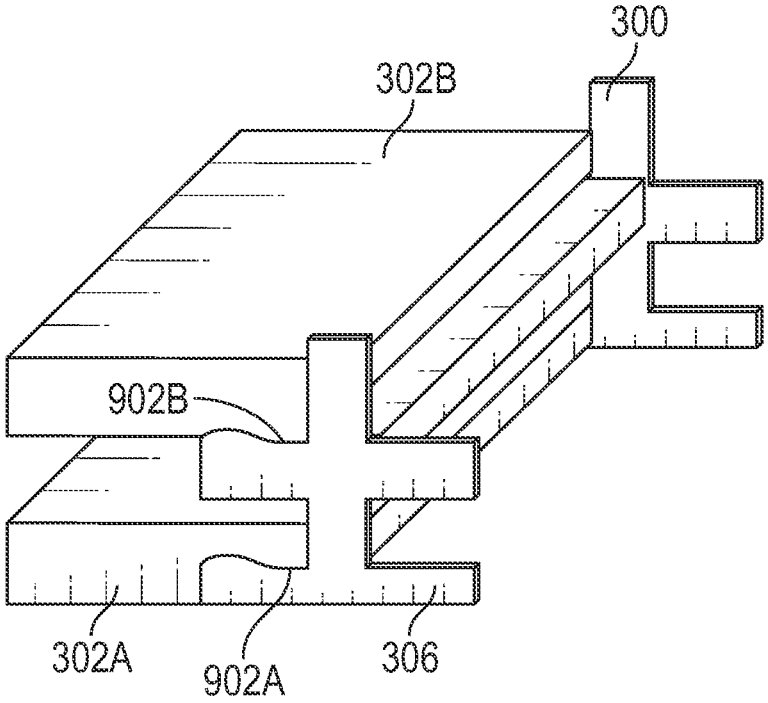
FIG. 9A is a schematic perspective view of one of the plurality of hot side planks and one of the plurality of cold side planks mounted to a structural element of the skeleton mesh structure, according to another embodiment of the present disclosure.

FIG. 9A is a schematic perspective view of one of the plurality of hot side planks 302A and one of the plurality of cold side planks 302B mounted to a structural element 306 of the outer mesh structure 300, according to another embodiment of the present disclosure. As shown in FIG. 9A, each of the plurality of hot side planks 302A is mounted to the structural elements 306 of the outer mesh structure 300 and an interface 902A between each of the plurality of hot side planks 302A and the corresponding structural element 306 has an S-like configuration. Similarly, each of the plurality of cold side planks 302B are mounted to the structural element 306 of the outer mesh structure 300 and an interface 902B between each of the plurality of cold side planks 302B, and the corresponding structural element 306 has an S-like configuration.

Figure 9B:
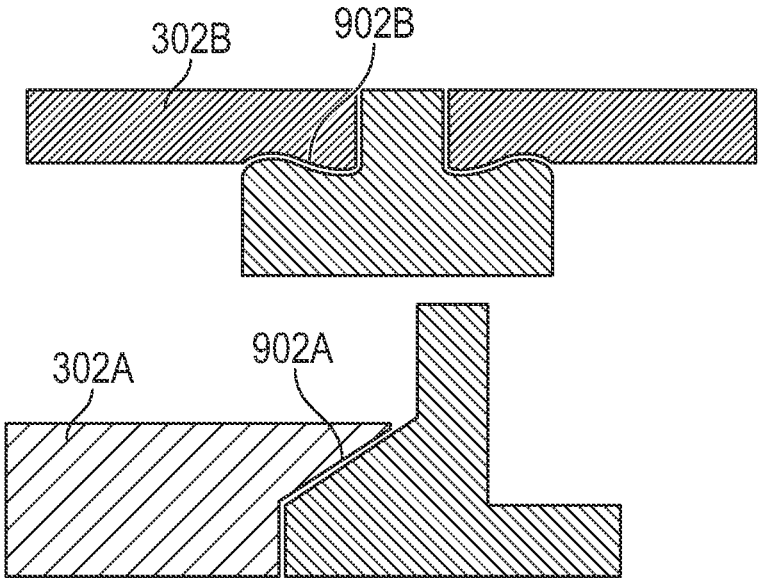
FIG. 9B is a schematic cross-sectional view of one of the plurality of hot side planks and one of the plurality of cold side planks mounted to the structural element of the skeleton mesh structure, according to an embodiment of the present disclosure.

FIG. 9B is a schematic cross-sectional view of one of the plurality of hot side planks 302A and one of the plurality of cold side planks 302B mounted to the structural element 306 of the outer mesh structure 300, according to an embodiment of the present disclosure. FIG. 9B shows that the interface 902B between each of the plurality of cold side planks 302B and the corresponding structural element 306 has an S-like configuration, whereas the interface 902A between each of the plurality of hot side planks 302A and the corresponding structural element 306 has a tapered configuration.

Figure 9C:
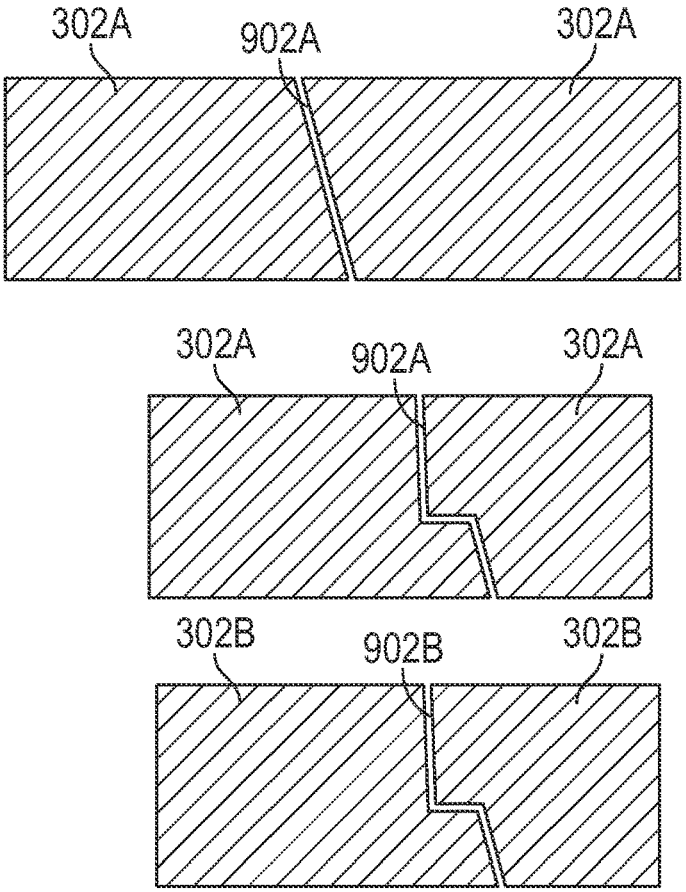
FIG. 9C is a schematic cross-sectional view of one of the plurality of hot side planks or one of the plurality of cold side planks mounted to the structural element showing various tapered or stepped configurations of the interface, according to various embodiments of the present disclosure.

FIG. 9C is a schematic cross-sectional view of one of the plurality of hot side planks 302A or one of the plurality of cold side planks 302B mounted to the structural element 306 showing various tapered or stepped configurations of the interface 902A, 902B, according to various embodiments of the present disclosure.

Figure 9D:
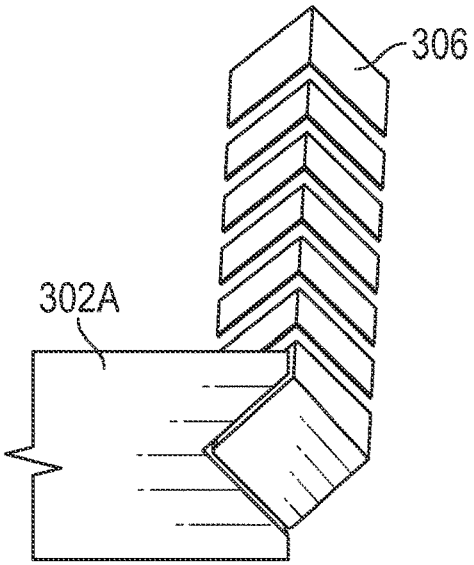
FIG. 9D is a schematic view of one of the plurality of hot side planks or one of the plurality of cold side planks mounted to the structural element showing a polygonal (e.g., a square) configuration of the interface, according to various embodiments of the present disclosure.

FIG. 9D is a schematic view of one of the plurality of hot side planks 302A or one of the plurality of cold side planks 302B mounted to the structural element 306 showing a polygonal (e.g., a square) configuration of the interface 902A, 902B, according to various embodiments of the present disclosure.

As described in the above paragraphs, the connection interface of the plurality of hot side planks 302A and/or the plurality of cold side planks 302B to the outer mesh structure 300 can be configured to be thermally expansion tolerant. Furthermore, the connection interface of the plurality of hot side planks 302A to the outer mesh structure 300 can be configured to improve performance in terms of reducing air leakage to a very minimal value or substantially eliminating the air leakage so that the interface does not impact aerodynamics for NOR/thermal field and film cooling. The interface between the plurality of hot side planks 302A and the outer mesh structure 300 can be an inverted "S" shape interface, a tapered interface, a step-like interface hanger free axial bolts on clips, variable clips with axial bolts for stress relief and to accommodate thermal growth, etc.

As can be appreciated from the discussion above, a combustor includes an inner liner and an outer liner defining a combustion chamber. The inner liner includes an inner mesh structure, a plurality of hot side planks mounted to a hot side of the inner mesh structure, and a plurality of cold side planks mounted to a cold side of the inner mesh structure. The outer liner includes an outer mesh structure, a plurality of hot side planks mounted to a hot side of the outer mesh structure, and a plurality of cold side planks mounted to a cold side of the outer mesh structure. The combustor further includes a plurality of clips configured to couple the plurality of hot side planks and the plurality of cold side planks to a plurality of structural elements of the inner mesh structure and the outer mesh structure.

The combustor according to the previous clause, the plurality of hot side planks being coupled to the plurality of clips that are, in turn, coupled to the plurality of structural elements.

The combustor according to any of the previous clauses, the plurality of cold side planks being coupled to the plurality of clips.

The combustor according to any of the previous clauses, further including a plurality of holding members configured to push the plurality of cold side planks against the plurality of clips to hold the plurality of cold side planks, and a plurality of fasteners configured to couple the holding members to the plurality of clips and to the structural elements.

The combustor according to any of the previous clauses, further including a plurality of resilient members provided between the plurality of structural elements and the plurality of clips to provide a seal between the plurality of structural elements and the plurality of clips.

The combustor according to any of the previous clauses, further including a plurality of fasteners to couple the plurality of clips to the structural elements, and to push the plurality of cold side planks against the plurality of clips to hold the plurality of cold side planks.

The combustor according to any of the previous clauses, further including a plurality of fasteners configured to retain the plurality of cold side planks against the plurality of clips, each of the plurality of fasteners being fastened using another fastener to each of the plurality of structural elements via an insert member.

Another aspect of the present disclosure is to provide a combustor including an inner liner and an outer liner defining a combustion chamber. The inner liner includes an inner mesh structure, a plurality of hot side planks mounted to a hot side of the inner mesh structure, and a plurality of cold side planks mounted to a cold side of the inner mesh structure. The outer liner comprising an outer mesh structure, a plurality of hot side planks mounted to a hot side of the outer mesh structure, and a plurality of cold side planks mounted to a cold side of the outer mesh structure. The combustor further includes a plurality of clips configured to couple the plurality of hot side planks to the plurality of cold side planks.

The combustor according to the previous clause, the plurality of hot side planks being coupled to the plurality of clips, and each pair of the plurality of clips being, in turn, coupled together using a fastener.

The combustor according to any of the previous clauses, further including a splitter sleeve provided as a spacer between each pair of the plurality of clips.

The combustor according to any of the previous clauses, the plurality of hot side planks being coupled to a plurality of structural elements of the inner mesh structure and the outer mesh structure.

The combustor according to any of the previous clauses, the plurality of cold side planks being mounted on the plurality of hot side planks.

The combustor according to any of the previous clauses, further including a plurality of holding members configured to push on the plurality of cold side planks against the plurality of hot side planks.

A further aspect of the present disclosure is to provide a turbine engine including a combustor. a combustor includes an inner liner and an outer liner defining a combustion chamber. The inner liner includes an inner mesh structure, a plurality of hot side planks mounted to a hot side of the inner mesh structure, and a plurality of cold side planks mounted to a cold side of the inner mesh structure. The outer liner includes an outer mesh structure, a plurality of hot side planks mounted to a hot side of the outer mesh structure, and a plurality of cold side planks mounted to a cold side of the outer mesh structure. The combustor further includes a plurality of clips configured to couple the plurality of hot side planks and the plurality of cold side planks to a plurality of structural elements of the inner mesh structure and the outer mesh structure.

The turbine engine according to the previous clause, the plurality of hot side planks being coupled to the plurality of clips that are, in turn, coupled to the plurality of structural elements.

The turbine engine according to any of the previous clauses, the plurality of cold side planks being coupled to the plurality of clips.

The turbine engine according to any of the previous clauses, further including a plurality of holding members configured to push the plurality of cold side planks against the plurality of clips to hold the plurality of cold side planks, and a plurality of fasteners configured to couple the holding members to the plurality of clips and to the structural elements.

The turbine engine according to any of the previous clauses, further including a plurality of resilient members provided between the plurality of structural elements and the plurality of clips.

The turbine engine according to any of the previous clauses, further including a plurality of fasteners to couple the plurality of clips to the structural elements, and to push the plurality of cold side planks against the plurality of clips to hold the plurality of cold side planks.

The turbine engine according to any of the previous clauses, further including a plurality of fasteners configured to retain the plurality of cold side planks against the plurality of clips, each of the plurality of fasteners being fastened using another fastener to each of the plurality of structural elements via an insert member.

Although the foregoing description is directed to the preferred embodiments of the present disclosure, other variations and modifications will be apparent to those skilled in the art, and may be made without departing from the spirit or the scope of the disclosure. Moreover, features described in connection with one embodiment of the present disclosure may be used in conjunction with other embodiments, even if not explicitly stated above.

We claim:

1. A combustor comprising:

an inner liner and an outer liner defining a combustion chamber, the inner liner comprising an inner mesh structure, a plurality of hot side planks mounted to a hot side of the inner mesh structure, and a plurality of cold side planks mounted to a cold side of the inner mesh structure, and the outer liner comprising an outer mesh structure, a plurality of hot side planks mounted to a hot side of the outer mesh structure, and a plurality of cold side planks mounted to a cold side of the outer mesh structure; and a plurality of clips configured to couple the plurality of hot side planks and the plurality of cold side planks of the inner liner to a plurality of structural elements of the inner mesh structure and/or to couple the plurality of hot side planks and the plurality of cold side planks of the outer liner to a plurality of structural elements of the outer mesh structure.

2. The combustor according to claim 1, wherein the plurality of hot side planks of the inner liner and/or the plurality of hot side planks of the outer liner are coupled to the plurality of clips, and each pair of the plurality of clips are, in turn, coupled respectively to the plurality of structural elements of the inner mesh structure and/or to the plurality of structural elements of the outer mesh structure.

3. The combustor according to claim 1, wherein the plurality of cold side planks of the inner liner and/or the plurality of cold side planks of the outer liner are mounted on the plurality of clips.

4. The combustor according to claim 1, further comprising a plurality of holding members configured to push the plurality of cold side planks of the inner liner and/or the plurality of cold side planks of the outer liner against the plurality of clips to hold the plurality of cold side planks of the inner liner and/or the plurality of cold side planks of the outer liner; and a plurality of fasteners that couple the plurality of holding members to the plurality of clips and to the plurality of structural elements of the inner mesh structure, and/or that couple the plurality of holding members to the plurality of clips and to the plurality of structural elements of the outer mesh structure.

5. The combustor according to claim 1, further comprising a plurality of resilient members provided between the plurality of structural elements of the inner mesh structure and the plurality of clips to provide a seal between the plurality of structural elements of the inner mesh structure and the plurality of clips, and/or the plurality of resilient members are provided between the plurality of structural elements of the outer mesh structure and the plurality of clips to provide the seal between the plurality of structural elements of the outer mesh structure and the plurality of clips.

6. The combustor according to claim 1, further comprising a plurality of fasteners to couple the plurality of clips to the plurality of structural elements of the inner mesh structure and to push the plurality of cold side planks of the inner liner against the plurality of clips to hold the plurality of cold side planks of the inner liner, and/or to couple the plurality of clips to the plurality of structural elements of the outer mesh structure and to push the plurality of cold side planks of the outer liner against the plurality of clips to hold the plurality of cold side planks of the outer liner.

7. The combustor according to claim 1, further comprising a plurality of fasteners configured to retain the plurality of cold side planks of the inner liner against the plurality of clips, each of the plurality of fasteners being fastened using another fastener to each of the plurality of structural elements of the inner mesh structure via an insert member, and/or to retain the plurality of cold side planks of the outer liner against the plurality of clips, each of the plurality of fasteners being fastened using said another fastener to each of the plurality of structural elements of the outer mesh structure via the insert member.

8. A combustor comprising:

an inner liner and an outer liner defining a combustion chamber, the inner liner comprising an inner mesh structure, a plurality of hot side planks mounted to a hot side of the inner mesh structure, and a plurality of cold side planks mounted to a cold side of the inner mesh structure, and the outer liner comprising an outer mesh structure, a plurality of hot side planks mounted to a hot side of the outer mesh structure, and a plurality of cold side planks mounted to a cold side of the outer mesh structure; and a plurality of clips configured to couple the plurality of hot side planks of the inner liner to the plurality of cold side planks of the inner liner, and/or to couple the plurality of hot side planks of the outer liner to the plurality of cold side planks of the outer liner.

9. The combustor according to claim 8, wherein the plurality of hot side planks of the inner liner or the plurality of hot side planks of the outer liner are coupled to the plurality of clips, and each pair of the plurality of clips, in turn, being coupled together using a fastener.

10. The combustor according to claim 8, further comprising a splitter sleeve provided as a spacer between each pair of the plurality of clips.

11. The combustor according to claim 8, wherein the plurality of hot side planks of the inner liner are coupled to a plurality of structural elements of the inner mesh structure and the plurality of hot side planks of the outer liner are coupled to a plurality of structural elements of the outer mesh structure.

12. The combustor according to claim 8, wherein the plurality of cold side planks of the inner liner are mounted on the plurality of hot side planks of the inner liner, and/or the plurality of cold side planks of the outer liner are mounted on the plurality of hot side planks of the outer liner.

13. The combustor according to claim 8, further comprising a plurality of holding members configured to push on the plurality of cold side planks of the inner liner against the plurality of hot side planks of the inner liner, or to push on the plurality of cold side planks of the outer liner against the plurality of hot side planks of the outer liner.

14. A turbine engine comprising:

a combustor comprising:

(a) an inner liner and an outer liner defining a combustion chamber, the inner liner comprising an inner mesh structure, a plurality of hot side planks mounted to a hot side of the inner mesh structure, and a plurality of cold side planks mounted to a cold side of the inner mesh structure, and the outer liner comprising an outer mesh structure, a plurality of hot side planks mounted to a hot side of the outer mesh structure, and a plurality of cold side planks mounted to a cold side of the outer mesh structure; and (b) a plurality of clips configured to couple the plurality of hot side planks and the plurality of cold side planks of the inner liner to a plurality of structural elements of the inner mesh structure, and/or to couple the plurality of hot side planks and the plurality of cold side planks of the outer liner to a plurality of structural elements of the outer mesh structure.

15. The turbine engine according to claim 14, wherein the plurality of hot side planks of the inner liner and/or the plurality of hot side planks of the outer liner are coupled to the plurality of clips, the plurality of clips, in turn, being coupled to the plurality of structural elements of the inner mesh structure and/or to the plurality of structural elements of the outer mesh structure.

16. The turbine engine according to claim 14, wherein the plurality of cold side planks of the inner liner and/or the plurality of cold side planks of the outer liner are mounted on the plurality of clips.

17. The turbine engine according to claim 14, further comprising a plurality of holding members configured to push the plurality of cold side planks of the inner liner and/or the plurality of cold side planks of the outer liner against the plurality of clips to hold the plurality of cold side planks of the inner liner and/or the plurality of cold side planks of the outer liner; and a plurality of fasteners to couple the plurality of holding members to the plurality of clips and to the plurality of structural elements of the inner mesh structure or to couple the plurality of holding members to the plurality of clips and to the plurality of structural elements of the outer mesh structure.

18. The turbine engine according to claim 14, further comprising a plurality of resilient members provided between the plurality of structural elements of the inner mesh structure and the plurality of clips to provide a seal between the plurality of structural elements of the inner mesh structure and the plurality of clips, and/or the plurality of resilient members are provided between the plurality of structural elements of the outer mesh structure and the plurality of clips to provide the seal between the plurality of structural elements of the outer mesh structure and the plurality of clips.

19. The turbine engine according to claim 14, further comprising a plurality of fasteners to couple the plurality of clips to the plurality of structural elements of the inner mesh structure and to push the plurality of cold side planks of the inner liner against the plurality of clips to hold the plurality of cold side planks of the inner liner, and/or to couple the plurality of clips to the plurality of structural elements of the outer mesh structure and to push the plurality of cold side planks of the outer liner against the plurality of clips to hold the plurality of cold side planks of the outer liner.

20. The turbine engine according to claim 14, further comprising a plurality of fasteners configured to retain the plurality of cold side planks of the inner liner against the plurality of clips, wherein each of the plurality of fasteners being fastened using another fastener to each of the plurality of structural elements of the inner mesh structure via an insert member, and/or to retain the plurality of cold side planks of the outer liner against the plurality of clips, wherein each of the plurality of fasteners being fastened using said another fastener to each of the plurality of structural elements of the outer mesh structure via the insert member.

* * * * *